United States Patent [19]

Tomioka et al.

[11] Patent Number: 4,709,783

[45] Date of Patent: Dec. 1, 1987

[54] APPARATUS FOR INSTALLING ESCAPE DEVICE FOR SLOWLY LOWERING A BODY

[75] Inventors: Hisatsugu Tomioka, Ibaraki; Tatsuo Waki; Yoshiki Miyata, both of Tokyo, all of Japan

[73] Assignee: Lonseal, Tokyo, Japan

[21] Appl. No.: 813,373

[22] Filed: Dec. 26, 1985

[30] Foreign Application Priority Data

Dec. 29, 1984 [JP] Japan ..... 59-201969[U]
Nov. 16, 1985 [JP] Japan ..... 60-177167[U]

[51] Int. Cl.[4] ..... A62B 1/16
[52] U.S. Cl. ..... 182/8; 182/198; 182/206
[58] Field of Search ..... 182/206, 3, 5, 150, 182/196–198, 8

[56] References Cited

U.S. PATENT DOCUMENTS

| | | | |
|---|---|---|---|
| 342,924 | 6/1886 | Nordenborg | 182/206 |
| 1,110,881 | 9/1914 | Brunelle | 182/60 |
| 2,823,957 | 2/1958 | Otani | 182/60 |
| 3,598,200 | 8/1971 | Thompson | 182/8 |
| 4,276,957 | 7/1981 | Kilgore | 182/150 |
| 4,542,804 | 9/1985 | Power | 182/3 |

*Primary Examiner*—Reinaldo P. Machado
*Attorney, Agent, or Firm*—Sandler & Greenblum

[57] ABSTRACT

An apparatus for installing an escape slow lowerer stably at an arbitrary place on a building. The apparatus has a ladder body, horizontal rods mounted on the ladder body and vertical rods mounted slidably and lockably on the horizontal rods to form a gate-like shape for holding the building. The apparatus further comprises a foldable ladder connected to the ladder body and a column having a metal fixture for supporting the escape lowerer.

25 Claims, 11 Drawing Figures

APPARATUS FOR INSTALLING ESCAPE DEVICE FOR SLOWLY LOWERING A BODY

BACKGROUND OF THE INVENTION

The present invention relates to an apparatus for installing an escape device for slowly lowering a body toward the ground.

An escape device for slowly lowering a body toward the ground is composed of a lowerer body and a rope. The lowering system has a built-in centrifugal brake, and the rope is engaged with the centrifugal brake for lowering a person who is hanging at an end of the rope at a constant gentle speed.

Such an escape lowering device is designed such that the lowering system is fixed to a building body when an accident such as a fire occurs, for lowering a person on the upper floors to the ground by carrying him at the end of the rope.

The lowering device is installed to a part of the building by suspending the lowering system with a metal which is fixture fixed in a stationary manner to a certain place of the building.

The prior art as described above has some disadvantages. Since the metal fixture is fixedly installed on a building, the position for installing the lowerer cannot be altered. In some fires, places directly below the escape device will be in flames. In such a case, the escape device can not be used safely.

Moreover, the external wall of a building in general affords no foot holds. It is therefore, very difficult to get out of the building, or climb over a fence.

Further, if the rope is not tensed, the escape device allows a person to fall freely until the rope is tensed. So the rope must be tensed before the person descends, otherwise the escape device will severely shock the person who falls freely after he starts to descend slowly. Such a shock could cause the person to be injured and also could cause the escape device to break. In the conventional escape device, it is utterly impossible to check the rope before starting descent and it is quite usual that a person would fall freely downward.

SUMMARY OF THE INVENTION

Accordingly, it is an object of the present invention to overcome the disadvantages as described above by providing an apparatus for installing an escape device for slowly lowering a body which can be set at arbitrary position for installing the escape device while enabling the escape device to be mounted in a stable manner on a building, thus allowing a person to get out of the building easily and to check the rope tension easily.

The foregoing object is accomplished in a first embodiment by providing an apparatus for installing an escape device for slowly lowering a person wherein horizontal rods are provided on the upper ends of a ladder body while vertical rods are mounted slidably and lockably on the horizontal rods such that a gate-like shape is formed by the ladder body and the horizontal and vertical rods and a part of a building is held by and between the ladder body and the vertical rods. A foldable ladder is provided below the ladder body in connection therewith and a column is provided over the ladder body in connection therewith which is provided with a metal fixture for supporting the escape device.

The foregoing object is also accomplished in a second embodiment by providing an apparatus for installing an escape device for slowly lowering a person wherein a column to which the escape device is fixed is provided over the ladder body in connection therewith and an approximately L-shaped holding portion consisting of horizontal rods and vertical rods is mounted on the upper ends of the longitudinal bars of the ladder body such that a part of a building is held by and between the holding part and the ladder body. The apparatus is characterized in that upper and lower slide rods both provided with screw engaging portions are mounted so as to extend between and be slidable along the vertical rods. The engaging portions are engaged respectively, with normally and inversely threaded portions formed on a mutually rotatable shaft supported vertically by the members of the holding portion, and swing rods are mounted rotatably at one ends thereof to the upper and lower slide rods, respectively. The swing rods are connected rotatably at intermediate portions thereof with one end of each link rod, the other end of the link rods being supported rotatably at at predetermined positions near the vertical rods.

DETAILED DESCRIPTION OF THE INVENTION

Figure 1:
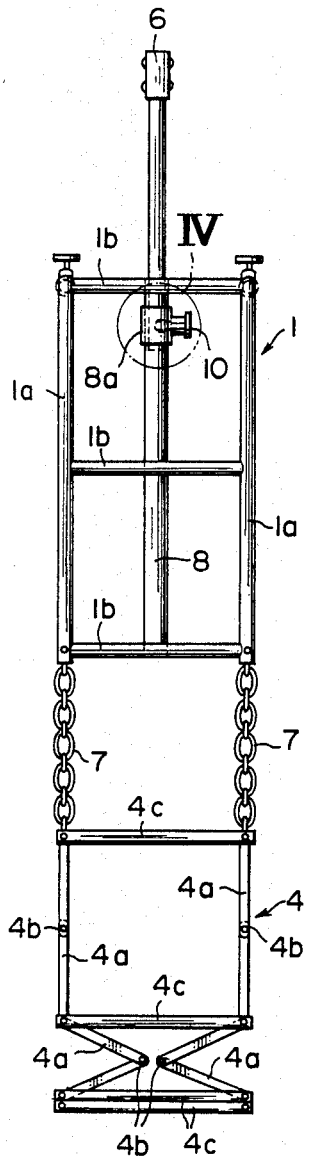
FIG. 1 is a front elevational view of the apparatus for installing an escape device for slowly lowering a person according to a first embodiment of the present invention.
Figure 2:
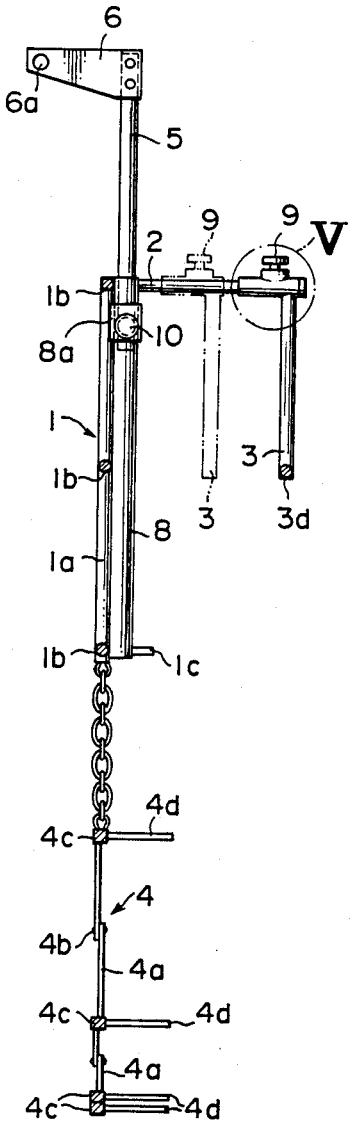
FIG. 2 is a side view of the first embodiment as shown in FIG. 1.
Figure 3:
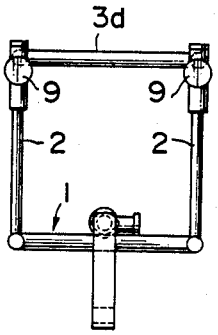
FIG. 3 is a plan view of the first embodiment of FIG. 1.

According to the first embodiment of the present invention are shown in FIGS. 1–6, an apparatus for installing an escape device for slowly lowering a body comprises a ladder body 1, horizontal rods 2, vertical rods 3, a foldable ladder 4, a column 5 and a metal fixture 6 to which a lowerer is to be fixed.

The ladder body 1 consists of two longitudinal bars 1*a* arranged in parallel with each other, three crossbars 1*b* disposed between the vertical bars 1*a* to form a ladder shape, and pins 1*c* projected horizontally from the lower end of each of the longitudinal bars 1*a*. These pins 1*c* are provided for securing a space between the ladder body 1 and the external wall of a building B so that ladder body 1 would not come into close contact with building B.

The horizontal rods 2 are provided at the upper ends of longitudinal bars 1*a* so as to project backward and horizontally therefrom. The vertical rods 3 are mounted slidably and lockably on the horizontaly rods 2 so as to form a gate-like shape together with the ladder body 1 and the horizontal rods 2.

Figure 5:
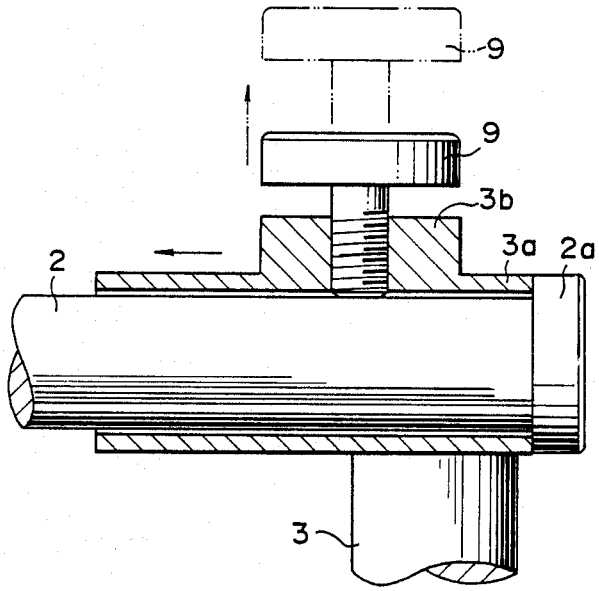
FIG. 5 is an enlarged cross-sectional view showing a portion V of FIG. 2.

Each horizontal rod 2 is made of a round bar and is provided at its tip with a stopper 2*a* for preventing the rod from slipping out, as shown in FIG. 5.

Each vertical rod 3 is provided with a cylinder 3*a*, an internal thread portion 3*b* formed integrally on the cylinder 3*a* and a locking screw 9 to be screwed into the internal thread portion 3*b*. The vertical rods 3 are further provided with crossbars 3*d* at the upper and lower ends thereof such that the crossbars 3*d* extend between the vertical rods 3.

A part of a building is held by and between ladder body 1 and vertical rods 3. Ladder body 1 and vertical rods 3 are locked onto building B by tightening the locking screw 9.

The foldable ladder 4 is provided below the ladder body 1 to be connected with the lower ends thereof through chains 7.

The foldable ladder 4 is composed of a support shaft 4*b* provided at both ends thereof with each three foldable longitudinal rods 4*a* which are arranged in parallel with each other, and four crossbars 4*c* provided between the longitudinal rods 4*a* so as to form a ladder shape. Each of the crossbars 4*c* is provided at both ends thereof with pins 4*d* projecting horizontally. These pins 4*d* are provided for the purpose of ensuring a space between the foldable ladder 4 and the external wall of the building to prevent them from coming into close contact with each other.

A fixing tube 8 is mounted on the ladder body 1 so as to extend through the ladder body 1 and to pass the center of each crossbar 1*b*, and the column 5 is fitted into the fixing tube 8 so as to project upward.

Figure 4:
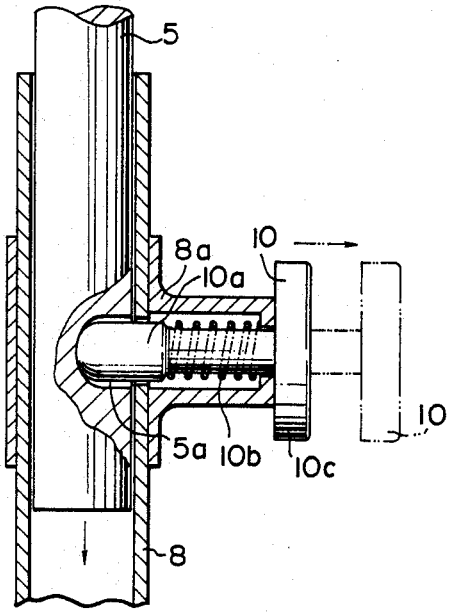
FIG. 4 is an enlarged cross-sectional view of the portion labelled IV of FIG. 1.

An approximately T-shaped external tube 8*a* as shown in FIG. 4 is fitted around the fixing tube 8. The external tube 8*a* is provided with a stopper 10 consisting of a handling portion 10*c* and a stopper portion 10*a*, and with a coil spring 10*b* mounted therein for energizing the stopper 10 inward.

The column 5 is made of a round bar provided with an engaging hole 5*a*. The column 5 is fitted slidably in fixing tube 8 while the hole 5*a* is detachably engaged with the stopper 10. The metal fixture 6 is mounted on the upper end of the column 5 for fixing the escape device.

The metal fixture 6 consists of a trapezoidal metal block having a fixing hole 6*a*. The escape device A is supported by fixing it to this fixing hole 6*a*.

Figure 6:
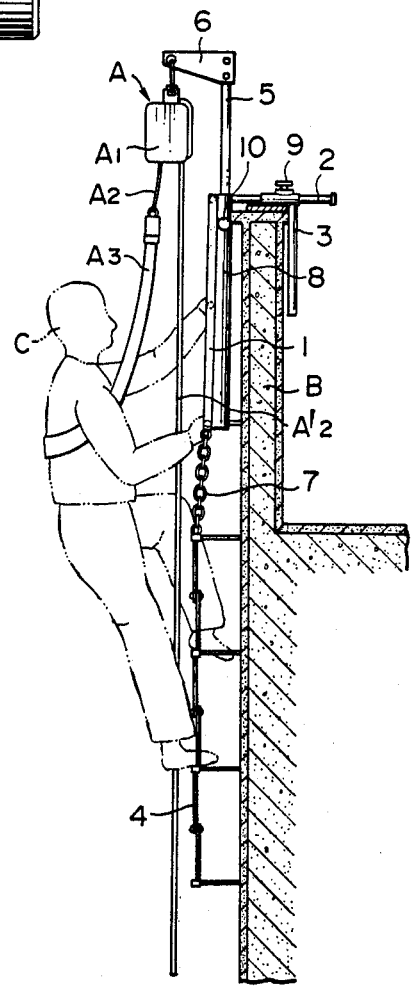
FIG. 6 is a side view of the first embodiment according to FIG. 1 of the apparatus as it appears during use.

Usage of the first embodiment according to the invention is now described with reference to FIG. 6, in which the reference code B indicates a part of a building such as a wall under a window or a fence on the roof. The escape device A consists of a lowering system $A_1$ and a rope $A_2$. Descending belts $A_3$ are provided at both ends of the rope $A_2$.

When the apparatus according to the present invention is not in use, the column is inserted into the fixing tube 8 and the foldable ladder 4 is folded.

For installing the apparatus, the foldable ladder 4 is first put out of the opening of a window to be positioned on the external wall of the building B, and the horizontal rods 2 are mounted on the building part B.

The locking screw 9 is then loosened to move the vertical rods 3 to such position where a space larger than the thickness of the building body B is defined between the vertical rods 3 and the ladder body 1, and the screw 9 is retightened to lock the vertical rods in the position.

The column 5 is drawn out of the fixing tube 8 and the engaging hole 5*a* of the column is engaged with the stopper 10 to lock the column 5 into position.

Finally, the escape device A is fixed to the apparatus so as to be suspended from the fixing hole 6*a*.

It is now described how the escape device is used.

A person C who is going to escape gets out of the window with the belt $A_3$ wound around his body and climbs down the ladder body 1 and the foldable ladder 4.

Confirming that the rope $A_2$ on the side connected to the belt $A_3$ wound around his body is not slack, he releases his hold of the ladders and starts to descend while being suspended the belt $A_3$. If the rope $A_2$ is slack, however, it must be tensioned by pulling the rope $A'_2$ on the other side before he starts to descend.

As the person C descends, the other end of the rope $A_2$ raises until another descending belt (not shown) connected to the subject end reaches directly under the lowering system $A_1$. Thus another person can escape, using this belt in a similar manner to the previously mentioned person C. The operation as described above is repeated.

It is now described how the apparatus of the embodiment is restored to the retracted position.

The escape device A is removed from the hole 6*a*. The stopper 10 is disengaged from the column 5 so that the column 5 is inserted into the fixing tube 8. The locking screw 9 is loosened to enlarge the space between the vertical rods 3 and the ladder body 1. The apparatus is removed from the building and turned upside down so that the horizontal rods 2 are put on the floor. The foldable ladder 4 is folded to be retracted between the ladder body 1 and the vertical rods 3 together with the escape device A.

A second embodiment of an apparatus for installing an escape device for slowly lowering a body according to the present invention, as shown in FIGS. 7–11, comprises a ladder body 1 provided with a column 5 for supporting the lowerer and an approximately L-shaped holding portion D provided on the upper end of the ladder body 1. The apparatus is thus adapted such that, when it is installed on a building, the holding portion D is engaged in locking relation with the building and the building is held by and between a holding mechanism E provided on the holding portion D and the ladder body 1.

The ladder body 1 is composed of longitudinal bars 1*a* and crossbars 1*b* mounted between the longitudinal bars 1*a* so as to extend between them. A foldable ladder 4 is connected to the lower end of the ladder body 1 through chains 7. A support tube 8 is mounted vertically to the crossbars 1*b* and the column 5 provided with a metal fixture 6 for fixing a lowerer is slidably inserted into the support tube 8, so that the column 5 can be locked in a position extended upwards by engaging a stopper 10 with an engaging hole 5*a* formed in the column 5.

Further, the approximately L-shaped holding portion D consisting of horizontal rods 2 and vertical rods 3 is mounted on the upper ends of the longitudinal bars 1*a* of the ladder body 1 while being held by a holding rod 3*c*, and as previously mentioned the holding mechanism E is provided on the vertical rods 3.

The holding mechanism E consists of upper and lower slide rods 11*a* and 11*a'*, a manually rotatable shaft 12, swing rods 13 and 13' and link rods 14 and 14'.

The manually rotatable shaft 12 is supported vertically and rotatably between supporting rods 15 and 15' which are disposed between the vertical rods 3 of the holding portion D, so that the shaft 12 can be rotated by rotating a foldable handle 12 provided on the upper end of the shaft 12. The manually rotatable shaft 12 is further provided with a normally threaded portion 12*b* and an inversely threaded portion 12*a* while an inhibiting portion 12*d* forming a boundary between the two portions at the center of the shaft 12.

The upper slide rods 11*a* and the lower slide rods 11*a'* are provided between slide tubes 11*b* and 11*b'* fitted slidably around the vertical rods 3. The upper and lower slide rods 11*a* and 11*a'* are provided at the center thereof with screw engaging portions 11*c* and 11*c'* which are engaged respectively with the aforementioned normally and inversely, that is, clockwise and counterclockwise threaded portions 12*a* and 12*b* on the manually rotatable shaft 12. In this manner, the upper and lower slide rods 11*a* and 11*a'* approach each other or are separated from each other by movement upward and downward, respectively, by rotating the manually rotatable shaft 12.

Rotary tubes 13*a* and 13*a'* are fitted around both ends of the upper and lower slide rods 11*a* and 11*a'*. The rear end of each of swing rods 13 and 13', which has a predetermined length, is secured to each of the rotary tubes 13*a* and 13*a'* so that the swing rods 13 and 13' are supported by the upper and lower slide rods 11*a* and 11*a'* to move in a swinging manner. Each swing rod 13 and 13' is provided with a slip-proof member 13*b* and 13*b'* at the tip thereof. The slip-proof members 13*b* and 13*b'* are made of rubber.

Figure 9:
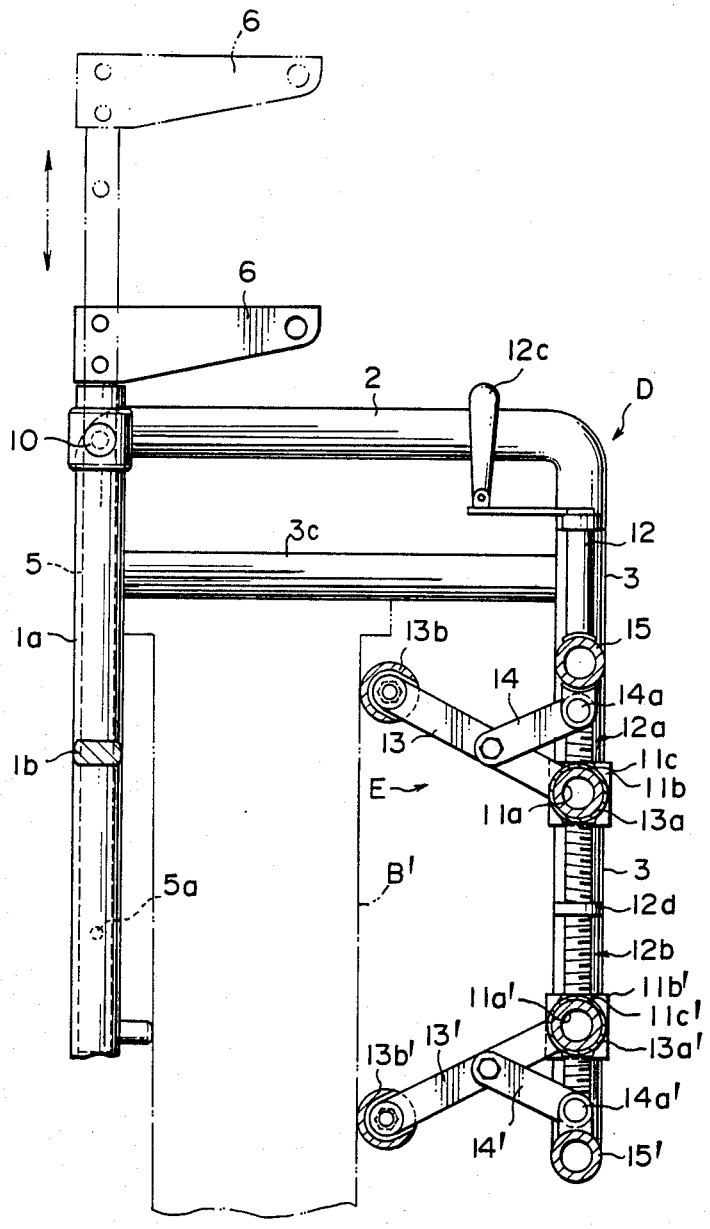
FIG. 9 is a cross-sectional view taken along line A—A of FIG. 10.
Figure 10:
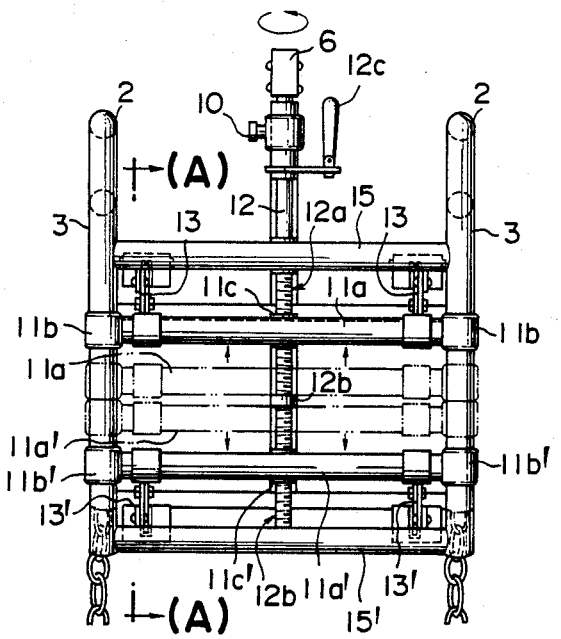
FIG. 10 is a front view showing the apparatus in which the upper and lower swing rods are moved up and down, respectively.

Further, one end of each link rod 14, 14' is rotatably supported at a predetermined intermediate place on the swing rod 13, 13'. The other end of link rods 14, 14' is rotatably supported at a predetermined position near the vertical rod 3, for example, at a supporting plate 16, 16' fixed to the rod 15, 15' near the vertical rod 3. As described above, the swing rods 13 and 13' are rotatably supported at the rear ends thereof by the upper and lower slide rods 11*a* and 11*a'* and rotatably supported at the intermediate portions thereof by the link rods 14 and 14'. Accordingly, when the shaft 12 is rotated to cause the upper and lower side rods 11*a* and 11*a'* to move upward and downward, respectively, the swing rods 14 and 14' are moved toward the vertical rods 3 and toward the ladder body 9, respectively, in accordance with the change in distance between the rods 13, 13' and the centers of the axes of the upper and lower slide rods 11*a*, 11*a'* as shown in FIGS. 7 and 9.

Usage of the apparatus is now described with reference to FIG. 11.

Figure 11:
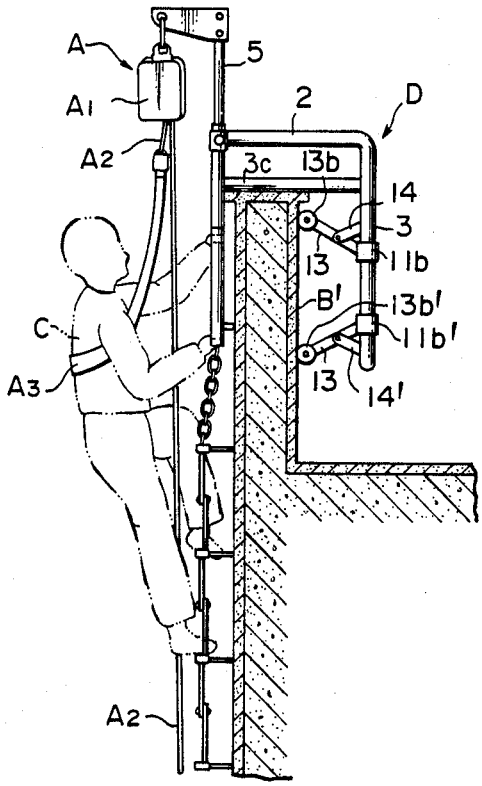
FIG. 11 is a side view showing the apparatus according to FIGS. 7–10 mounted in proper position for use.

In FIG. 11, the reference code B' indicates a part of a building such as a wall under a window or a fence on the roof. A escape device A consists of a lowering system $A_1$ and a rope $A_2$ which is provided with descending belts $A_3$ at both ends thereof.

Figure 7:
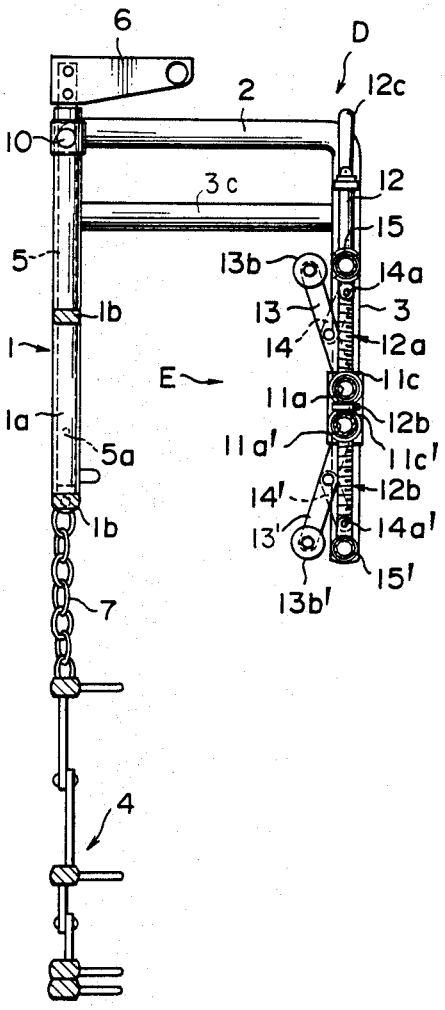
FIG. 7 is a side cross-sectional view of a second embodiment of the present invention.
Figure 8:
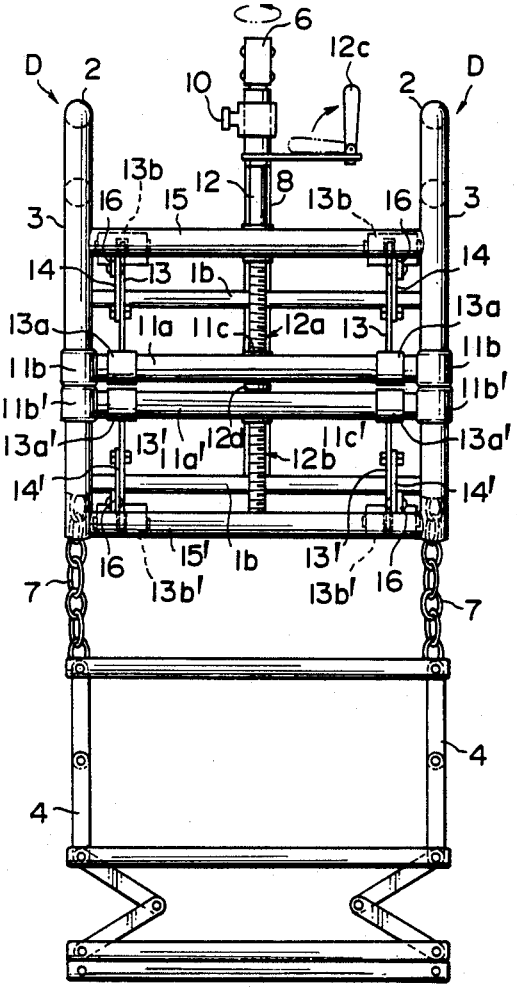
FIG. 8 is a front view of a second embodiment according to FIG. 7.

When the apparatus of the second embodiment according to the present invention is not in use, the column 5 is inserted into the support tube 8, the foldable ladder 4 is folded and the swing rods 13 and 13' are folded on the vertical rods 3 as shown in FIG. 7.

For using the apparatus, the foldable ladder 4 is first placed outside of the opening in a window, the ladder body 1 is positioned on the external wall of the building B' and the holding rod 3*c* of the holding portion D is mounted on the building part B'.

The handle 12*c* is then rotated to rotate the manually rotatable shaft 12 so as to move the upper and lower slide rods 11*a* and 11*a'* upward and upward, respectively. The swing rods 13 and 13' are thereby moved to the building B' so as to press the slip-proof members 13*b* and 13*b'* at the tips thereof against the building B'. The building B' is held by the tips of the swing rods 13*a* and 13*a'* and the longitudinal bars 1*a* in a stable manner, without any shaking.

The column 5 is drawn out of the support tube 8 while turning it toward the outside of the building, and locked by engaging the stopper 10 with the engaging hole 5*a*.

Finally, the escape device is fixed to the apparatus to be suspended with the metal fixture 6.

It is now described how the escape device is used.

A person who is going to escape gets out of a window with the descending belt $A_3$ wound around his body and climbs down the ladder body 1 and the foldable ladder 4.

Confirming that the rope $A_2$ on the side connected to the belt $A_3$ wound around the body is not slack, he releases his hold on the ladders and starts to descend while being suspended by the belt $A_3$. If the rope $A_2$ is slack, however, it must be tensed by pulling the rope $A_2'$ on the other side before starting to descend.

As the person descends, the other end of the rope $A_2$ raises until another descending belt (not shown) connected to the subject end reaches directly under the lowerer body A. Thus another person can escape, using this belt in a similar manner to the previously mentioned person C. The operation as described above is repeated.

The holding portion D and the longitudinal bar 1*a* of the ladder 1 of the apparatus according to the invention are formed integrally by bending a single pipe into a U shape. The important feature of their construction is that the ladder body 1 is opposed to the vertical rods 3 and parallel thereto. So the holding portion D and the longitudinal bar 1*a* of the ladder 1 may be constructed separately, or they may be formed into a U shape with the horizontal rods being curved into an arch shape.

Further, when the ladder body 1 supports the person C, the tip of the lower swing rod 13' tends to separate from the surface of the building B' due to some bending in the holding portion D. Such a disadvantage can be overcome by using a lower swing rod 13' which has a length somewhat larger than the upper swing rod 13.

Effects and advantages as follows can be provided according to the first embodiment as described above, in which horizontal rods are mounted on the upper end of a ladder body while vertical rods are mounted slidably and lockably on the horizontal rods such that a gate-like shape is formed and part of the building is held by and between the ladder body and the vertical rods, a foldable ladder is provided below the ladder body to be connected thereto, and a column is provided over the ladder body to be connected therewith which is provided with a metal fixture for supporting the escape lowerer.

Since the apparatus is adapted to hold a part of the building between the ladder body and the vertical rods it can be installed in any arbitrary position along or on the building. Therefore, in case of a fire, for example, the apparatus can be installed in a place where the flames are less strong.

Since the apparatus is adapted to set the ladders on the external wall of a building, it allows a person to get out of the building quite easily.

Further, since the rope of the escape lowerer can be checked for its tension by a person with his foot on the ladders, the lowerer does not cause free descent, and thereby the person is prevented from beinig injured and the lowerer is prevented from breaking down.

Still further, since the ladder of the apparatus is composed of a ladder body and a foldable ladder, it is compact in construction and convenient for handling or transportation.

On the other hand, according to the second embodiment of the present invention, the screw engaging portions on the upper and lower slide rods are moved up and down respectively along the normally and inversely threaded portions on the manually rotatable shaft by rotating the subject shaft, and thereby the upper and lower slide rods are caused to slide up and down, respectively.

In this embodiment, the swing rods rotatably support by the upper and lower slide rods are caused to move toward the ladder body and the vertical rods, respectively. The swing rods are also supported at their intermediate portions by the tips of the link rods.

By moving the swing rods toward the ladder body while the holding portion of the ladder body is engaged with the building part, the tips of the swing rods are pressed against the surface of the building part so as to hold the building part in cooperation with the longitudinal bars of the ladder body.

Accordingly, since the apparatus is adapted to hold the building with the ladder body and the tips of the swing rods while the tips of the swing rods are pressed against the surface of the building, the ladder body can be mounted in a stable manner without shaking.

Further, since the apparatus is adapted to hold the building while the tips of the upper and lower swing rods are in contact with the surface of the building on the sides of the vertical rods, the apparatus can be prevented from shaking even if the surface of the building is not smooth. In a conventional apparatus, shaking is caused by a gap between vertical rods and the surface of a building.

What is claimed is:

1. An apparatus for supporting an escape device for slowly lowering a person from a structure toward the ground comprising:

(a) a ladder assembly having an upper portion for mounting said ladder assembly to said structure, with at least two horizontal bars mounted to said upper portion; and (b) at least two vertical rods mounted on said at least two horizontal bars such that a gate-like shape is formed by said ladder assembly upper portion, said at least two horizontal bars, and said at least two vertical rods, wherein each of said vertical rods is substantially L-shaped in cross-section and has at least one substantially horizontal cylindrical portion which is adapted to receive one horizontal bar, each said horizontal cylindrical portion being attached to one end of a substantially vertical portion of each said vertical rod and further comprising a threaded section which is adapted to receive a screw for detachably connecting said horizontal bars and said vertical rods to each other, said vertical portions having second ends attached to each other by a lower horizontal member, wherein a portion of said structure is held by and between said ladder assembly and said at least two vertical rods.

2. The apparatus according to claim 1 further comprising:

(a) a column connected to said ladder assembly adapted to extend above said upper portion; and (b) a metal fixture connected to said column for removably supporting said escape device.

3. The apparatus according to claim 2 wherein said ladder assembly comprises:

(a) a first ladder comprising said upper portion;

(b) a foldable ladder connected below said first ladder.

4. The apparatus according to claim 1 wherein each of said at least two vertical rods is lockably and slidably mounted on respective ones of said at least two horizontal bars by said screws.

5. An apparatus for supporting an escape device for slowly lowering a person from a structure toward the ground comprising:

(a) a ladder assembly having longitudinal bars;

(b) at least two horizontal bars mounted to upper ends of said longitudinal bars;

(c) at least two vertical bars mounted to said at least two horizontal bars to form a substantially L-shaped holding portion, such that a portion of said structure is held by and between said holding portion and said ladder assembly; '(d) a rotatable shaft supported vertically by said holding portion; and (e) at least two slide rods slidably mounted on said at least two vertical rods, each of said at least two slide rods comprising engaging portions for reciprocatably mounting said at least two slide rods on said rotatable shaft to secure said apparatus to said structure.

6. The apparatus according to claim 5 wherein said rotatable shaft comprises a clockwise threaded portion and a counterclockwise threaded portion wherein an upper one of said at least one slide rods is connected by its engaging portion to said clockwise threaded portion and a lower one of said at least one slide rods is connected by its engaging portion to said counterclockwise threaded portion.

7. The apparatus according to claim 6 further comprising at least two swing rods each having one end rotatably mounted on said at least two slide rods.

8. The apparatus according to claim 7 further comprising at least two link rods each having one end rotatably mounted to a corresponding one of said at least two swing rods at a substantially middle portion of each swing rod, and said at least two link rods each having another end rotatably mounted to at least one supporting rod at a predetermined position substantially adajacent to said at least one vertical rod.

9. The apparatus according to claim 8 further comprising:

(a) a column connected to said ladder assembly so as to extend above said ladder assembly; and (b) a metal fixture connected to said column for removably supporting said escape device.

10. The apparatus according to claim 9 wherein said ladder assembly comprises:

(a) a first ladder comprising said longitudinal bars; and (b) a foldable ladder connected below said first ladder.

11. An apparatus for removably supporting an escape device on a structure for slowly lowering a person from said structure toward the ground, said escape device comprising a rope operatively connected to a lowering system, said lowering system comprising a centrifugal brake, said apparatus comprising:

(a) a ladder assembly comprising a plurality of vertical bars;

(b) a plurality of horizontal bars connected at one end to an upper end of corresponding ones of said plurality of vertical bars;

(c) a plurality of vertical rods connected at one end to another end of corresponding ones of said plurality of horizontal bars, wherein said apparatus is supported on said structure by said plurality of vertical bars, said plurality of horizontal bars and said plurality of vertical rods, wherein at least one support rod is connected between said plurality of vertical rods, a rotatable shaft being supported in a vertical fashion by said at least one support rod between said plurality of vertical rods, and a foldable handle is positioned on an upper end of said rotatable shaft for rotating said shaft.

12. The apparatus according to claim 11 wherein said ladder assembly comprises:

(a) a rigid ladder;

(b) a foldable ladder connected below said rigid ladder.

13. The apparatus according to claim 12 wherein said ladder assembly further comprises a plurality of chains for connecting said rigid ladder to said foldable ladder, each of said plurality of chains having one end connected to said rigid ladder and each of said plurality of chains having another end connected to said foldable ladder.

14. The apparatus according to claim 13 wherein said rigid ladder comprises:

(a) said plurality of vertical bars;

(b) a plurality of horizontal rungs connected at a plurality of joints to said plurality of vertical bars; and (c) a plurality of pins extending from said joints for ensuring a space between said ladder means and said structure when said apparatus is supported on said structure.

15. The apparatus according to claim 11 further comprising a support connected to and extending above said ladder assembly for removably supporting said escape device.

16. The apparatus according to claim 15 wherein said support comprises:

(a) a fixing tube;

(b) a column adapted to be retracted into said fixing tube; and (c) means for extending said column from said fixing tube.

17. The apparatus according to claim 16 wherein said means for extending comprises a stopper adapted to fit into a recess in said column and into a corresponding recess in said fixing tube for maintaining said column in an extended position.

18. The apparatus according to claim 11 wherein said plurality of vertical rods are slidably mounted on said plurality of horizontal bars, each of said plurality of vertical rods have a substantially L-shaped and include a cylinder which is inserted on said plurality of horizontal bars, said cylinder comprising locking means for locking said vertical rod on the corresponding horizontal bar.

19. The apparatus according to claim 18 further comprising at least one crossbar connected to said plurality of vertical rods.

20. The apparatus according to claim 11 wherein said rotatable shaft comprises:

(a) a first threaded portion having clockwise threads;

(b) a second threaded portion having counterclockwise threads; and (c) an inhibiting portion forming a boundary between said first and second threaded portions.

21. The apparatus according to claim 20 further comprising:

(a) at least two upper slide tubes slidably mounted on said plurality of vertical rods;

(b) at least two lower slide tubes slidably mounted on said plurality of vertical rods;

(c) at least one upper slide rod mounted between said at least two upper slide tubes, said at least one upper slide rod comprising an engaging portion positioned substantially in the center of said at least one upper slide rod for engaging said first threaded portion of said shaft; and (d) at least one lower slide rod mounted between said at least two lower slide tubes, said at least one lower slide rod comprising an engaging portion positioned substantially in the center of said at least one lower slide rod for engaging said second threaded portion of said shaft, wherein when said foldable handle is rotated, said at least one upper slide rod moves toward said at least one lower slide rod along said rotatable shaft.

22. The apparatus according to claim 21 further comprising:

(a) two rotary tubes fitted around each of said at least one upper and lower slide rods, each of said two rotary tubes being positioned substantially adjacent to each end of the at least one upper and lower slide rods; and (b) two swing rods swingably mounted on said at least one upper and lower slide rods, one end of each of said two swing rods being connected to a corresponding one of said two rotary tubes, another end of each of said two swing rods comprising a rubber tip.

23. The apparatus according to claim 22 further comprising two link rods with each link rod having one end rotatably connected to one of said two swing rods at a predetermined position on the swing rod and each link rod having another end rotatably connected to one support rod at a position substantially adjacent to one of said plurality of vertical rods.

24. An apparatus for removably supporting an escape device on a structure for slowly lowering a person from said structure towards the ground, said escape device comprising a rope operatively connected to a lowering system, said lowering system comprising a centrifugal brake, said apparatus comprising:

(a) a ladder assembly comprising a plurality of vertical bars;

(b) a plurality of horizontal bars connected at one end to an upper end of corresponding ones of said plurality of vertical bars;

(c) a plurality of vertical rods connecting at one end to another one of corresponding ones of said plurality of horizontal bars, wherein said apparatus is supported on said structure by said plurality of vertical bars, said plurality of horizontal bars and said plurality of vertical rods, said plurality of vertical rods being slidably mounted on said plurality of horizontal bars, with each of said plurality of vertical rods having a substantially L-shaped cross-sectional configuration and including a cylindrical portion which is adapted to be inserted on one of said plurality of horizontal bars, said vertical bars having lower ends attached to each other by a lower horizontal member, said cylinder comprising means for locking said vertical rod on a corresponding horizontal bar, each said cylindrical portion comprising means for locking one of said vertical rods on a corresponding horizontal bar, each of said cylindrical portions comprising a threaded portion, and said locking means comprising a screw which is adapted to be screwed into said threaded portion.

25. The apparatus in accordance with claim 13 further comprising a foldable ladder assembly comprising a plurality of collapsible vertical bars, a plurality of horizontal rungs joined to said vertical bars at joints, and a plurality of support pins extending from said joints.

* * * * *

UNITED STATES PATENT AND TRADEMARK OFFICE

CERTIFICATE OF CORRECTION

PATENT NO. : 4,709,783

DATED : December 1, 1987

INVENTOR(S) : Hisatsugu TOMIOKA et al.

It is certified that error appears in the above-identified patent and that said Letters Patent is hereby corrected as shown below:

At column 1, lines 10 and 11, change "body toward the ground" to ---person---.

At column 1, line 11, change "lowerer body" to ---lowering system---.

At column 1, line 22, change "which is fixture" to ---fixture which is---.

At column 2, line 11, insert ---,--- after "engaged" and before "respectively".

At column 2, line 15, change "ends" to ---end---.

At column 2, line 19, change "at at" to ---at---.

At column 2, line 52, change "are" to ---as---.

At column 3, line 2, change "horizontaly" to ---horizontal---.

At column 4, line 2, change "in the" to ---into ---.

At column 4, line 17, insert ---by--- after "suspended" and before "the".

At col. 5, line 59, change "A" (first occurrence) to --An--.

At col. 6, line 10, change "the" (second occurrence) to --his--.

At column 6, line 10, insert ---13b, 13b'--- after "tips" and before "of".

At column 7, line 7, change "beinig to ---being ---.

At column 7, line 21, change "support" to --- supported---.

At column 8, line 29 (in claim 5, line 11), delete "'" after the ";" and before "(d)".

At column 8, line 29 (in claim 5, line 11),

UNITED STATES PATENT AND TRADEMARK OFFICE

CERTIFICATE OF CORRECTION

PATENT NO. : 4,709,783

DATED : December 1, 1987

INVENTOR(S) : Hisatsugu TOMIOKA et al.

It is certified that error appears in the above-identified patent and that said Letters Patent is hereby corrected as shown below:

begin a new paragraph at "(d)".

At column 9, line 66 (in claim 18, line 4), change "L-shaped" to ---L-shape---.

At column 10, line 66 (in claim 24, line 13), change "one" to ---end---.

Signed and Sealed this

Thirteenth Day of June, 1989

*Attest:*

*Attesting Officer*

DONALD J. QUIGG

*Commissioner of Patents and Trademarks*